US006138333A

United States Patent [19]

Hollingworth

[11] Patent Number: 6,138,333

[45] Date of Patent: Oct. 31, 2000

[54] ADJUSTABLE EARRING

[76] Inventor: Franklin D. Hollingworth, 40 N. State St. No. 2E, Salt Lake City, Utah 84103

[21] Appl. No.: 09/312,802

[22] Filed: May 17, 1999

[51] Int. Cl.[7] ..... A44B 21/00; A44C 7/00

[52] U.S. Cl. ..... 24/705; 24/108; 24/706; 24/673; 63/12; 63/13

[58] Field of Search ..... 24/705, 108, 706, 24/91, 673; 63/12, 13, 29 R

[56] References Cited

U.S. PATENT DOCUMENTS

| | | | |
|---|---|---|---|
| 216,954 | 7/1879 | Heckmann . | |
| 527,358 | 10/1894 | Bonner . | |
| 867,943 | 10/1907 | Boles | 24/673 |
| 1,324,466 | 12/1919 | Pirro | 24/705 |
| 4,292,715 | 10/1981 | Huddon | 24/155 |
| 4,307,582 | 12/1981 | Macini | 63/12 |
| 4,353,370 | 10/1982 | Evans | 128/269 |
| 4,580,417 | 4/1986 | Sardelli | 63/12 |
| 4,630,453 | 12/1986 | Burkett | 63/12 |
| 4,631,929 | 12/1986 | Hollingworth | 63/13 |
| 4,686,837 | 8/1987 | Carre | 63/12 |
| 4,723,421 | 2/1988 | Nitsche | 63/12 |
| 4,928,367 | 5/1990 | Seidman | 24/705 |
| 5,987,718 | 11/1999 | Kelly | 24/705 |

FOREIGN PATENT DOCUMENTS

| | | |
|---|---|---|
| 580651 | 11/1924 | France . |
| 3002522 | 7/1981 | Germany . |
| 569917 | 11/1957 | Italy . |

*Primary Examiner*—Victor N. Sakran
*Attorney, Agent, or Firm*—Mallinckrodt & Mallinckrodt; Robert R. Mallinckrodt; Brian R. Rayve

[57] ABSTRACT

An earring includes a pin adapted to pass through a hole pierced in an ear or other body part. The pin has an enlarged, decorative end thereon which rests against one side of the ear with the pin extending through the hole in the ear, and a clutch which fits over the opposite end of the pin and rests against the opposite side of the ear to hold the earring therein. The clutch includes a spring for receiving the pin therein and having a reduced inside diameter intermediate turn thereof which is stretched by the pin as it passes therethrough. There is at least one circumferential receiving groove in the pin to receive and hold the reduced inside diameter spring turn. Thus, the clutch may be positioned so that the reduced inside diameter turn is received in one of the at least one grooves. This resists movement of the clutch along the pin. With multiple grooves the grooves are positioned along the pin so that for each groove, the earring comfortably fits a different size ear.

12 Claims, 2 Drawing Sheets

ADJUSTABLE EARRING

BACKGROUND OF THE INVENTION

1. Field

The invention is in the field of earrings of the type having a pin which passes through a hole pierced in the ear of a wearer and is secured by a clutch on the end of the pin.

2. State of the Art

Earrings for use with pierced ears generally have a pin with a decorative end whereby the pin is passed through a hole pierced in an earlobe, so that the decorative end of the pin rests against one side of the earlobe. A clutch is then placed on the pin from the opposite end and slid along the pin until it contacts the other side of the earlobe to comfortably hold the earring in place with the decorative end of the pin contacting one side of the earlobe and the clutch contacting the other side.

Generally, it is not desirable to have the earring dangle loosely in the hole through the ear so it is desirable to maintain the clutch in position along the pin against the earlobe once a comfortably snug fit is obtained. Further, it is desirable to have the clutch resist sliding off the end of the pin in which case the earring usually falls from the ear and is lost. Many earrings in use today utilize clutches having one or more spring members which frictionally engage the pin to resist sliding of the clutch along the pin once the clutch is positioned by the user. However, while the pressure of the spring member or members on the smooth pin resists sliding to some extent, it is not uncommon for the clutch to work loose during wearing.

Many earrings provide grooves in the pin toward the end of the pin to provide additional resistance to movement of the clutch along the pin once the spring member or members reach the groove. This hopefully prevents the clutch from coming off the end of the pin and the earring being lost. In some cases two grooves are provided along the pin, one as a first stop, and the second at the end of the pin as a last attempt to prevent loss of the earring. In such earrings, the grooves are not engaged during normal wearing of the earring. The clutches rely entirely on the frictional sliding resistance provided by the spring members against the pin to maintain their wearing position on the pin.

U.S. Pat. No. 4,292,715 to Huddon, and my prior U.S. Pat. No. 4,631,929, both show clutches wherein a spring member is positioned in a receiving groove during normal wearing of the earring. U.S. Pat. No. 4,292,715 shows two receiving grooves, both of which simultaneously receive opposite, inwardly extending ends of a coil spring used as the spring member when the clutch is in position on the pin. However, such clutch is not adjustable along the pin. The grooves are positioned for a particular size ear, and the earring does not fit comfortably on either larger or smaller ears. This lack of adjustability is a disadvantage of the clutch described, although once in position with the spring ends in the receiving grooves, the clutch does tend to resist sliding movement to a greater degree than most other clutches.

The clutch of my prior U.S. Pat. No. 4,631,929 has a spring member in the form of an inwardly extending end of a coil spring, similar to that shown in Huddon, which engages a single wide groove in the pin. Thus, while the clutch has the same tendency to resist sliding off the pin as the Huddon clutch, because of the width of the receiving groove, the clutch can be adjustably slid to various positions along the groove to adjust for different size ears. However, this adjustment is obtained merely by frictional pressure of the spring member against the smooth bottom of the wide groove and this does not maintain adjusted positions any better than most other types of clutches.

It has been found that with clutches wherein the end of a coil spring is bent inwardly to engage a groove in the pin, it can be difficult to release the clutch because as the pin is pulled outwardly, the spring is also pulled outwardly against the end of the clutch which is usually angled and which tends to force the end of the spring into the groove. Thus, the harder a person pulls to try to release the clutch, the more difficult it is to release the clutch.

SUMMARY OF THE INVENTION

According to the invention, a clutch which extends over a grooved pin extending from a decorative portion of an earring through an ear of a user has a spring therein with an intermediate turn of the spring of smaller inside diameter than the remainder of the turns of the spring. The intermediate turn is of an inside diameter so that the pin stretches the turn as it slides through the spring and so that it extends into one of the circumferential grooves in the pin to hold the pin in the clutch. Since the reduced diameter turn is intermediate the ends of the spring, it is not urged inwardly into the groove by the end of the clutch housing so, while still providing good holding power for the pin, may be easily stretched to release the pin when pressure is applied between the pin and clutch to allow the pin to be easily removed.

It is preferred that the pin have several grooves therein so that the clutch can be adjustably secured to the pin. This provides an earring that is adjustable to small, medium, and large ears. Because the reduced diameter turn of the spring is received in a spring receiving groove of the pin, the clutch is held relatively securely in a groove against movement along the pin. Thus, a comfortable fit is maintained, risk of loss of the earring is reduced, and the earring is easy to put on and take off.

THE DRAWINGS

The best mode presently contemplated for carrying out the invention is illustrated in the accompanying drawings, in which:

FIG. 1 is an exploded view of an earring incorporating the invention;

FIG. 2, a vertical section through an earlobe and the clutch of an earring of the invention in position on an ear, showing the pin in elevation; and FIG. 3, a vertical section on the line 3—3 of FIG. 2.

DETAILED DESCRIPTION OF THE ILLUSTRATED EMBODIMENT

Figure 1:
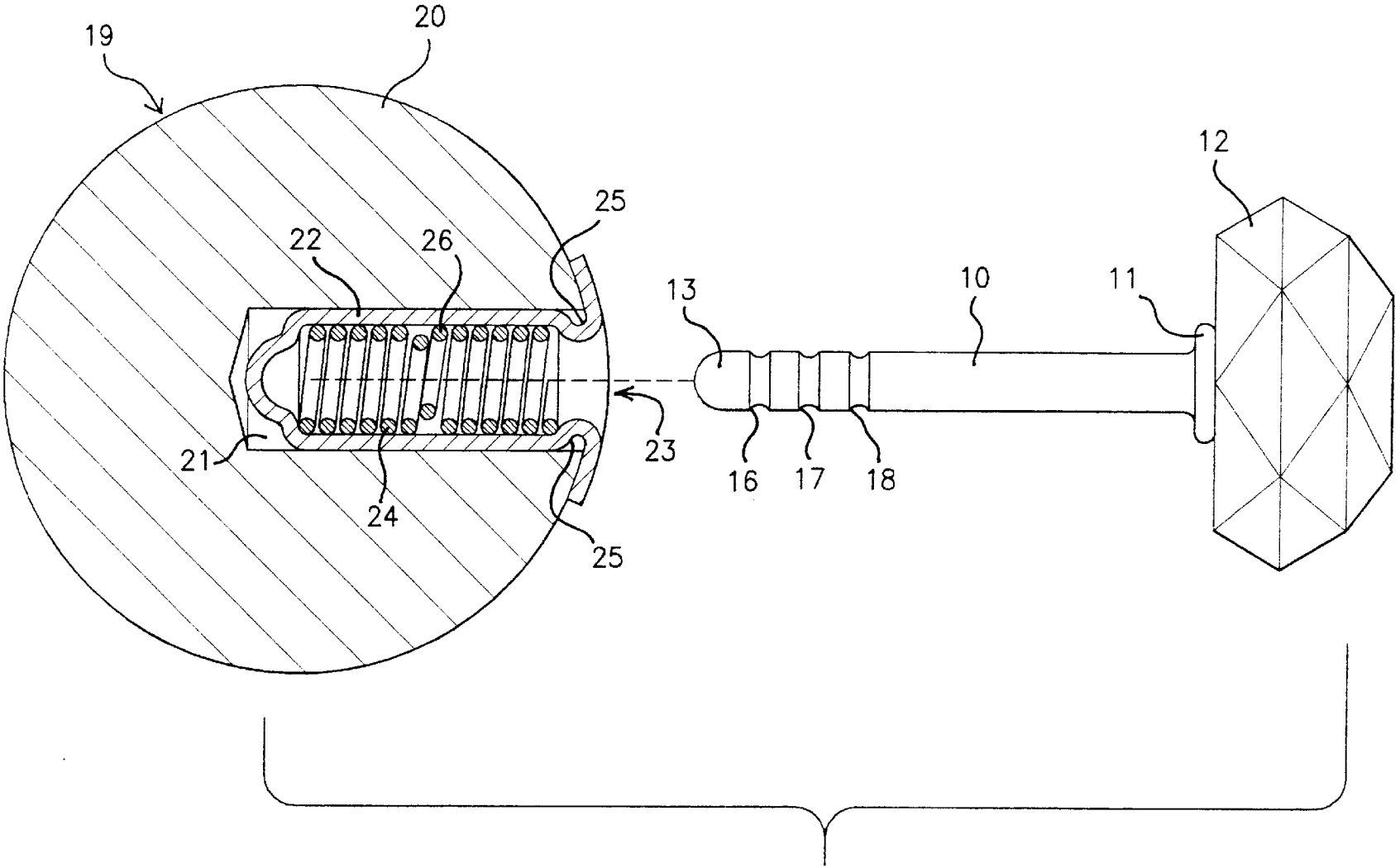
Figures 2, 3:
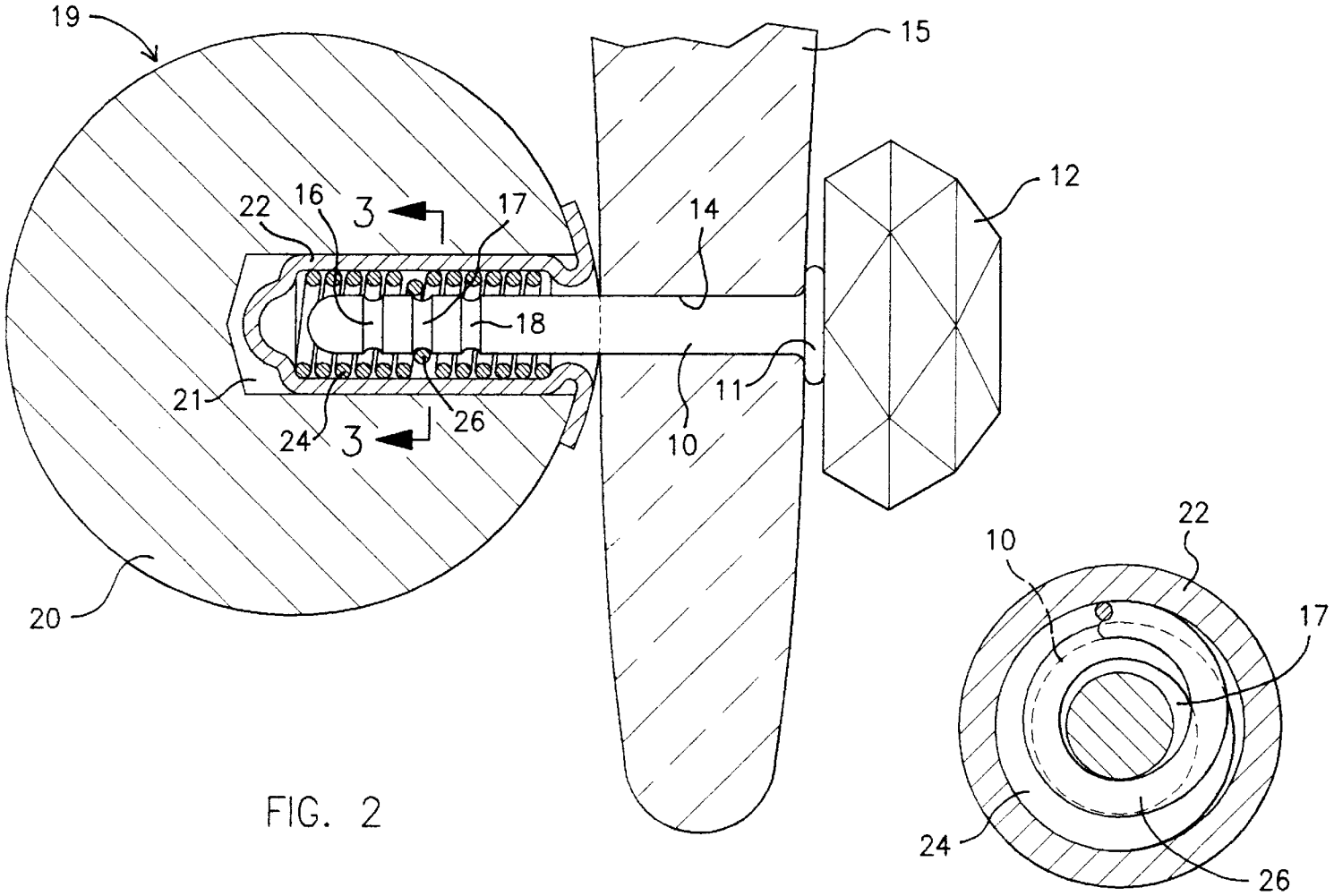

As shown in FIG. 1, an earring of the invention includes a pin 10 having an enlarged decorative end 11 to which a decoration, such as a jewel 12, is secured, and a small end 13 adapted for passage through a hole 14, FIG. 2, pierced through an earlobe 15. The diameter of the pin is such to also pass through hole 14 in the earlobe. The small end 13 of the pin may have various configurations, such as the rounded end shown, to ease passage of the pin through the receiving hole. The pin is provided with three grooves 16, 17, and 18 spaced therealong.

The clutch portion of the earring 19 includes a body 20 having a bore 21 therein which receives a cylindrical spring housing 22, open at 23 to receive end 13 of pin 10. A spring 24 is held in position within spring housing 22 by crimps 25. The spring housing 22 is held in body 20 as by gluing, or, if housing 22 and body 20 are metallic, alternatively by soldering. To insert pin 10 into the clutch, the small end 13 of the pin is merely pushed into opening 23 where it slides through the interior of spring 24. The reduced diameter winding 26 of spring 24 is resiliently deflected outwardly to substantially the same diameter of pin 10 and as pin 10 is moved into the interior of the spring, reduced diameter winding 26 will snap into groove 16. As pin 10 is inserted further into clutch 19, reduced diameter winding 26 will expand and slide along pin 10 and then snap into groove 17. If pin 10 continues to be moved into clutch 19, reduced diameter winding 26 will expand and slide along pin 10 and then snap into groove 18. Reduced diameter winding 26, when in a groove, will hold pin 10 relatively securely in clutch 19. As shown in FIG. 2, when groove 17 is positioned adjacent reduced diameter spring winding 26, winding 26 is biased into groove 17. This provides positive resistance to movement of clutch 19 along pin 10 as opposed to merely the frictional resistance provided by a spring biased against a smooth pin 10 as in the prior art.

FIG. 2 shows the earring placed on a medium size ear wherein a comfortable fit on the ear is obtained with reduced diameter spring winding 26 in second groove 17. If a smaller ear is to be fitted, clutch 19 is slid along pin 10 until reduced diameter spring winding 26 engages groove 18. For a large size ear, reduced diameter spring winding 26 will engage groove 16. The spacing between grooves 16, 17, and 18, and their position along pin 10, will be such that the earring can comfortably fit the average small, medium, and large sized ear. The spacing and positioning of the grooves may vary with earrings directed to adults and those directed to children, although the positioning of the grooves may be such that grooves 17 and 18 may accommodate various sizes of children's ears, while grooves 16 and 17 accommodate various sizes of adult ears. Further, any number of grooves may be used and in some instances four, five, or more grooves may be desirable.

The earrings of the invention provide several step size adjustments, the number and size of the steps depending upon the number and spacing of the grooves. Provision of the step adjustments, rather than the continuously variable size adjustment provided with no grooves, is generally not a disadvantage because it has been found that the steps can be made so that the earrings will comfortably fit a wide range of ear sizes. The increased resistance to movement of the clutch along the pin after once set, more than compensates for the lack of continuous adjustability.

The strength of the spring, and particularly reduced diameter winding 26 which engages grooves 16, 17, or 18, is set so that when engaged in a groove, it will resist moving out of the groove under normal wearing pressure, but may be easily displaced from the groove under force from a user sliding the clutch along the pin. Thus, during initial placement of clutch 19 on pin 10, the user can easily slide the clutch so that spring winding 26 engages first groove 16, and then groove 17, and, if desired, then groove 18. The spring winding 26 will move in and out of the grooves as the clutch is slid along the pin.

Spring 24 is generally wound of round spring wire and grooves 16, 17, and 18 which receive the reduced diameter spring winding 26 are generally of U-shaped configuration to accept reduced diameter spring winding 26. However, other groove configurations, such as V-shaped or V-shaped with a flat bottom, can be used. The receiving groove is usually sized to closely receive the spring winding therein.

It is preferred that the inside diameter of spring 24 be just larger than the outside diameter of pin 10 so that it, other than reduced winding 26, does not frictionally engage pin 10. However, it should not be so large as to noticeably wobble on pin 10. Further, while it is presently preferred to have reduced diameter spring winding 26 at or near the center of the length of the spring, as shown, the reduced diameter winding could be located at any location intermediate the ends of the spring, i.e., any winding but the opposite end windings.

Further, while the invention has been referred to as an earring, the invention may be used with pierced body parts generally and the terminology earring used herein includes similar items used with other body parts.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

What is claimed is:

1. An earring, comprising a pin adapted to extend through a hole pierced in an ear and having a length, a diameter, and small end adapted for passage through the hole, a decorative end sized to rest against the ear and block passage of the decorative end through the hole, and at least one circumferential groove intermediate the length of the pin; a clutch adapted to receive the small end of the pin therein and to slide along the pin to engage the side of the ear opposite that against which the decorative end rests, said clutch being sized to not pass through the hole and to thereby secure the earring in the hole in the ear; a spring in the clutch having an inside diameter through which the pin can pass without substantially stretching the spring and an intermediate turn of the spring with a reduced inside diameter through which the pin will not extend without stretching the reduced inside diameter turn and which, when received in a circumferential groove of the at least one circumferential groove in the pin, will cause the clutch to resist sliding along the pin.

2. An earring according to claim 1, wherein the reduced inside diameter intermediate turn of the spring is approximately centered along the length of the spring.

3. An earring according to claim 1, wherein the at least one circumferential groove is three circumferential grooves.

4. An earring, comprising a pin adapted to extend through a hole pierced in an ear and having a length, a diameter, and small end adapted for passage through the hole, a decorative end sized to rest against the ear and block passage of the decorative end through the hole, and at least three circumferential grooves intermediate the length of the pin; a clutch adapted to receive the small end of the pin therein and to slide along the pin to engage the side of the ear opposite that against which the decorative end rests, said clutch being sized to not pass through the hole and to thereby secure the earring in the hole in the ear; a spring in the clutch having an inside diameter through which the pin can pass and an intermediate turn of the spring with a reduced inside diameter through which the pin will not extend without stretching the reduced inside diameter turn and which, when received in one of the circumferential grooves of the at least three circumferential grooves in the pin, will cause the clutch to resist sliding along the pin, wherein the three circumferential grooves are located along the length of the pin so that when the reduced inside diameter intermediate turn of the spring is received in one of the grooves, the earring is sized to comfortably fit an ear of particular average size.

5. An adjustable earring, comprising a pin adapted to extend through a hole pierced in an ear and having a length, a diameter, and small end adapted for passage through the hole and a decorative end sized to rest against the ear and block passage of the decorative end through the hole; a clutch adapted to received the small end of the pin therein and to slide along the pin to engage the side of the ear opposite that against which the decorative end rests, said clutch being sized to not pass through the hole and to thereby secure the earring in the hole in the ear; a spring in the clutch having an inside diameter through which the pin can pass and having an intermediate turn of the spring with a reduced inside diameter through which the pin will not extend without stretching the reduced inside diameter turn; a plurality of receiving grooves in the pin sized to receive at least a portion of the reduced inside diameter turn therein and to resist sliding of the reduced inside diameter turn therefrom, and spaced along the pin a preset distance from the decorative end of the pin so that by engaging the reduced inside diameter turn of the clutch in a selected receiving groove, the clutch is positioned along the pin to comfortably receive a certain size of ear between the decorative end and the clutch, and by engaging the reduced inside diameter turn in other selected receiving grooves, the clutch is positioned along the pin to comfortably receive certain other sizes of ears between the decorate end and the clutch.

6. An adjustable earring according to claim 5, wherein there are three resilient member receiving grooves.

7. An adjustable earring according to claim 6, wherein the receiving grooves are configured similarly to the reduced inside diameter turn of the spring to closely receive the reduced inside diameter turn of the spring therein.

8. An adjustable earring according to claim 7, wherein the receiving grooves are U-shaped in configuration.

9. In an earring including a pin having a decoration end and an end portion adapted to extend through a portion of an ear, and a clutch having a spring adapted to receive the end portion of the pin therein and to secure it therein, the improvement comprising a spring with turns of inside diameter through which the pin can pass without substantially stretching the spring but having an intermediate turn thereof having a reduced inside diameter which is stretched as the pin is received in the spring; and a circumferential receiving groove in the pin for receiving at least a portion of the reduced inside diameter turn of the spring, said receiving groove located along the pin to receive the reduced inside diameter turn therein when the clutch is positioned along the pin to comfortably receive an ear between the decoration end of the pin and the clutch.

10. In an earring including a pin having a decoration end and an end portion adapted to extend through a portion of an ear, and a clutch having a spring adapted to receive the end portion of the pin therein and to secure it therein, the improvement comprising a reduced inside diameter intermediate turn of the spring which is stretched as the pin is received in the spring, and a plurality of circumferential receiving grooves closely spaced along the pin for receiving at least a portion of the reduced inside diameter spring turn in a selected on of the receiving grooves to comfortably receive an ear between the decoration end of the pin and the clutch.

11. An earring according to claim 10, wherein there are three receiving grooves.

12. An earring, comprising a pin adapted to extend through a hole pierced in an ear and having a length, a diameter, and small end adapted for passage through the hole, a decorative end sized to block passage of the decorative end through the hole, and at least one circumferential groove intermediate the length of the pin; a clutch adapted to receive the small end of the pin therein, said clutch being sized to not pass through the hole and to thereby secure the earring in the hole in the ear; a spring in the clutch having an inside diameter through which the pin can pass without substantially stretching the spring and an intermediate turn of the spring with a reduced inside diameter through which the pin will not extend without stretching the reduced inside diameter turn and which, when received in a circumferential groove of the at least one circumferential groove in the pin, will cause the clutch to resist sliding along the pin.

* * * * *